United States Patent [19]

Nakanishi et al.

[11] 4,322,962

[45] Apr. 6, 1982

[54] METHOD OF PRODUCING H-BEAMS

[75] Inventors: Teruyuki Nakanishi, Kibi; Kiyoshi Hitomi, Kurashiki, both of Japan

[73] Assignee: Kawasaki Steel Corporation, Hyogo, Japan

[21] Appl. No.: 74,501

[22] Filed: Sep. 11, 1979

[30] Foreign Application Priority Data

Sep. 12, 1978 [JP] Japan ..... 53-112731

[51] Int. Cl.[3] ..... B21B 1/12; B21B 27/02

[52] U.S. Cl. ..... 72/234; 72/225

[58] Field of Search ..... 72/234, 225, 366; 148/11.5 R, 12 R

[56] References Cited

U.S. PATENT DOCUMENTS

| | | | |
|---|---|---|---|
| 1,068,467 | 7/1913 | Vassen | 72/225 |
| 1,784,865 | 12/1930 | Fahrenwald | 148/12 R |
| 3,335,590 | 8/1967 | Noda et al. | 72/225 X |
| 3,597,954 | 8/1971 | Nakajima | 72/225 |

FOREIGN PATENT DOCUMENTS

| | | | |
|---|---|---|---|
| 53-10946 | 4/1978 | Japan | 72/234 |

*Primary Examiner*—Milton S. Mehr

*Attorney, Agent, or Firm*—Stevens, Davis, Miller & Mosher

[57] ABSTRACT

A method of producing, by universal mills, H-beams which are excellent in the strength and toughness of the joint between web and flanges. In roughing process, symmetric convexes, which have substantially the same cross section and differ in position in different mills, are alternately formed on at least either of the outer and inner sides of the web and flanges of the piece being rolled, to forcibly cause metal flow in the joints between web and flanges and thereby to increase the amount of strain of said joints. In finishing process, the convexes formed in said roughing process are pressed, thereby obtaining a H-beam having predetermined dimensions.

3 Claims, 30 Drawing Figures

METHOD OF PRODUCING H-BEAMS

BACKGROUND OF THE INVENTION

1. Field of the Invention

This invention relates to a method of producing H-beams by universal mills. More particularly this invention relates to a method of producing H-beams which have excellent strength and toughness in the joints between the web and flanges, referred to hereinbelow as the "fillets."

2. Prior Art

The conventional method of producing H-beams by rolling comprises: a breakdown process in which the piece 10 having a cross section as shown in FIG. 1 (*a*) is rolled by a twohigh mill having breakdown rolls 12 of a pass cross section as shown in FIG. 1 (*b*); a roughing process in which rolling in one pass or in multiple passes is performed by a roughing universal mill group consisting of at least one universal mill having roughing and intermediate horizontal rolls 14 and roughing and intermediate vertical rolls 16 as shown in FIG. 1 (*c*), and at least one edger mill having edger rolls 18 of a cross section as shown in FIG. 1 (*d*); and a finishing process in which rolling in one pass is performed by a finishing universal mill having finishing horizontal rolls 20 and finishing vertical rolls 22 of a cross section as shown in FIG. 1 (*e*). The H-beam 23 thus produced has flanges 24, web 26, and joints (fillets) 28 therebetween. An example of the mechanical properties of each part of the conventional H-beam thus rolled is given in FIG. 2. FIG. 2 (*a*) shows the relationship between the finish temperature and the yield strength. FIG. 2 (*b*) shows the relationship between the finish temperature and the tensile strength. FIG. 2 (*c*) shows the relationship between the finish temperature and the transition temperature of brittleness-ductility fractured surface. In the figure, the full line A, broken line B and dot-and-dash line C show the mechanical properties of the web 26, flange 24 and fillet 28 respectively. As is seen from the figure, when the finish temperature is the same, the yield strength and tensile strength of the fillet 28 in the tensile test are lower than those of the flange 24 and web 26, and the transition temperature of brittleness-ductility fractured surface in the Charpy test is the highest. The possible cause of such weakness in mechanical properties of the fillet 28 in comparison with other parts is considered to be the insufficient draft of the fillet 28 as compared with other parts, and because the fillet receives the highest temperature during rolling. That is, as the fillet 28 is supported only by the web 26 that is high in temperature and flexible, reductions by vertical rolls 16 to 22 in the roughing and the finishing processes are not effective. Further, the fillet 28 is larger in thickness than the web 26 and flange 24, so that heat radiation to the rolls is small. Therefore, the fillet receives the highest temperature during rolling.

FIG. 3 shows the state of deformation in cross section by rolling of each part of the H-beam. If the flange, fillet and web of the piece 10 have square section a, b and c respectively, these square sections become sections a', b', and c' in the H-beam 23 after rolled. As is apparent from the figure, the change in cross section of the flange from a to a' and that of the web from c to c' are featured each by a large decrease in either the vertical dimension or the horizontal dimension, while in the change in cross section of the fillet from b to b', the vertical and horizontal dimensions of the section b are decreased similarly, to almost the same extent, as the result of the metal flow that takes place from the fillet to the web because reductions by vertical rolls 16 to 22 are not effective as described in the above. Supposing that the deformation of the web and flange is plane strain and that the deformation of the fillet is one-dimensional tensile strain, the amount of true strain of the web and flange is equal to about 1.15 times that of the fillet.

Usually in the manufacture of H-beams, the product processed in the above rolling processes is straightened by a roller or press straightener to improve its straightness. However, when the H-beam produced by the above-mentioned conventional method is being straightened by rollers 30 as shown in FIG. 4 (*a*), due to its inferior mechanical properties the fillet 28 may occasionally be fractured as shown at the hatched portion 32 of FIG. 4 (*b*), with increasing amounts of reduction by the rollers 30. Therefore, for H-beams produced by the conventional method, press straightening has to be employed if straightness cannot be improved without heavy reductions, which results in a considerable decrease of the working efficiency.

H-beams before use are often subjected to gas cutting, that is, part of the flange 24 of the H-beam 23 is gas cut as shown by oblique lines 34 in FIG. 5 (*a*), and part of the web 26 of the H-beam is gas cut as shown by oblique lines 36 in FIG. 5 (*b*). However, when conventional H-beams are subjected to the above gas cutting, notches 37 resulting from the gas cutting may give rise to a crack 38 along the fillet 28 as shown in FIG. 5 (*c*) or (*d*), due to the inferior mechanical properties of the fillet. The crack 38 is caused by the influence of the residual stress existing in the fillet 28. The lower the low-temperature toughness of the fillet 28 is in a cold working environment, the more the crack progresses. To prevent this crack, the following measures have hitherto been taken. A hole is made in advance in the fillet 28 for prevention of crack propagation, troublesome operations such as preheating or post heating of the fillet 28 are performed, or costly killed steel, excellent in toughness, is used in place of semi-killed steel used for ordinary H-beams, as the result of which the cost of production of H-beams is raised.

Further, H-beams sometimes are used for monorails as a special application thereof as shown in FIG. 6 in which the reference numerals 39, 40 and 41 designate respectively a vehicle, a guide wheel and a carrying track on which a H-beam, the monorail, is fixed. In using H-beams for monorails, it has so far been required to make the fillet 28 larger in thickness in order to compensate for its insufficient strength.

SUMMARY OF THE INVENTION

This invention has been accomplished in order to eliminate the above-described drawbacks in the prior art, and it is the object of the invention to provide a method and means for producing H-beams which have excellent strength and toughness of the fillets.

The method and means for producing H-beams by universal mills according to this invention are characterized in that the amount of strain of the fillet is increased to improve its strength and toughness by providing the following processes: a breakdown process; a roughing process in which, in performing rolling in one pass or repeatedly in two passes or more by two or more roughing universal mills, symmetric convexes, which have substantially the same cross section and differ in position in different mills, are alternately formed on at least either of the outer and inner sides of the web and flanges of the piece being rolled, to forcibly cause metal flow in the joints between web and flanges and thereby to increase the amount of strain of the joints; and a finishing process in which the convexes formed in the above roughing process are pressed, thereby obtaining a H-beam having predetermined dimensions.

H-beams produced by the method of this invention are so excellent in mechanical properties that they can endure severe plastic working, are free from such restrictions on roller straightening and bending as have so far been imposed, and thus permit high-efficiency work.

In using conventional H-beams in a cold district, they have had to be made of killed steel, in many cases, in order to prevent propagation of notches resulting from gas cutting. In H-beams according to the invention, however, inexpensive semi-killed steel can be used satisfactorily in a cold working environment. Further, when they are used for monorails, the fillet need not be made larger in thickness because of its strength being high, which permits reduction in the weight of the structure.

BRIEF DESCRIPTION OF THE DRAWINGS

The above mentioned features and objects of the present invention will become more apparent with reference to the following description taken in conjunction with the accompanying drawings wherein like reference numerals denote like elements, and in which:

FIG. 12 is a sectional view showing the pass shape, used in the embodiment of this invention, of the vertical roll and horizontal roll of a roughing universal mill;

FIG. 13 is a sectional view showing another example of the pass shape, used in the embodiment of this invention, of the vertical roll and horizontal roll;

FIG. 14 is a process diagram showing examples of mill arrangement used in the embodiment of this invention.

DETAILED DESCRIPTION OF THE INVENTION

Figure 1A:
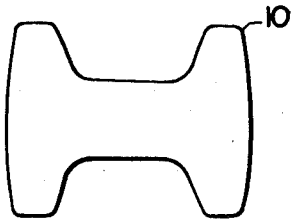
FIG. 1a PRIOR ART
FIG. 1 is a process diagram showing a conventional process of producing H-beams.
Figure 1B:
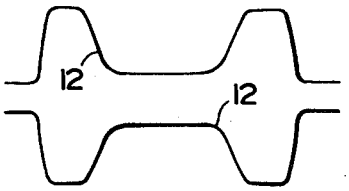
FIG. 1b PRIOR ART
Figure 1C:
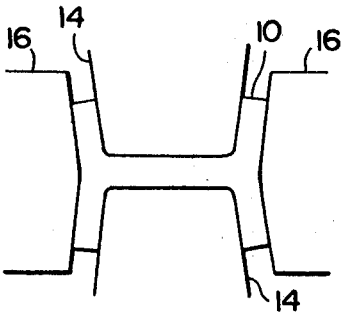
FIG. 1c PRIOR ART
Figure 1D:
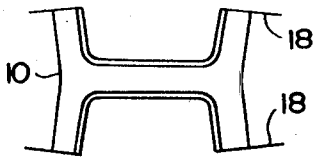
FIG. 1d PRIOR ART
Figure 1E:
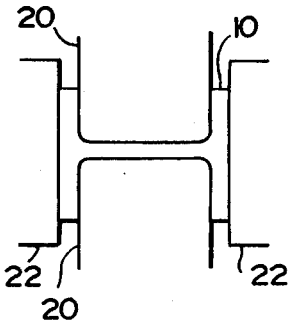
FIG. 1e PRIOR ART
Figure 1F:
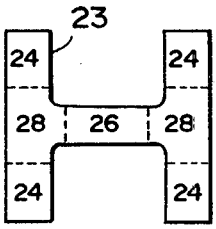
FIG. 1f PRIOR ART
Figure 2A:
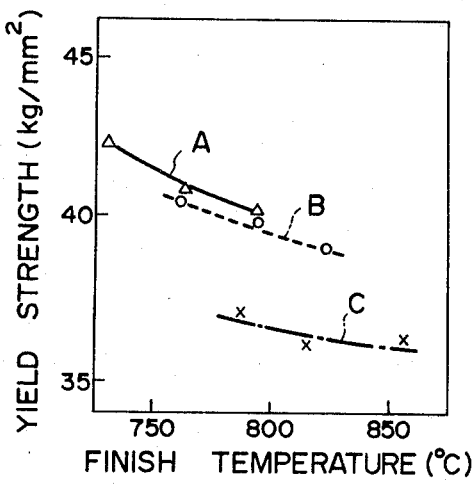
PRIOR ART FIG. 2a
FIG. 2 is a diagram showing the mechanical properties of each part of the H-beam produced by the conventional method.
Figure 2B:
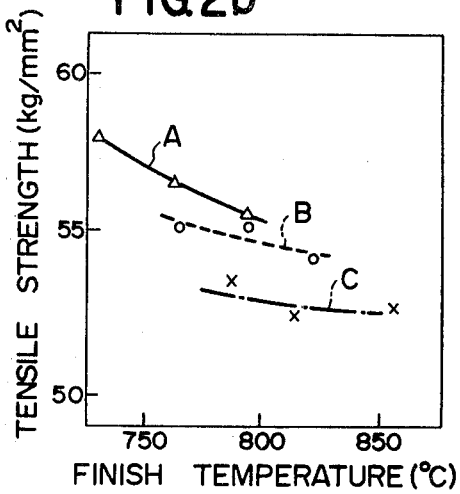
PRIOR ART FIG. 2b
Figure 2C:
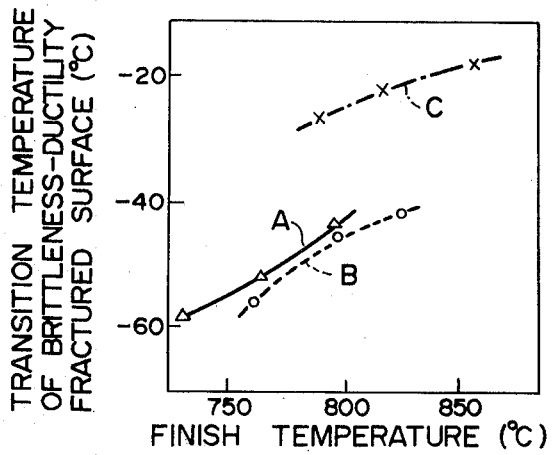
FIG. 2c PRIOR ART
Figure 3:
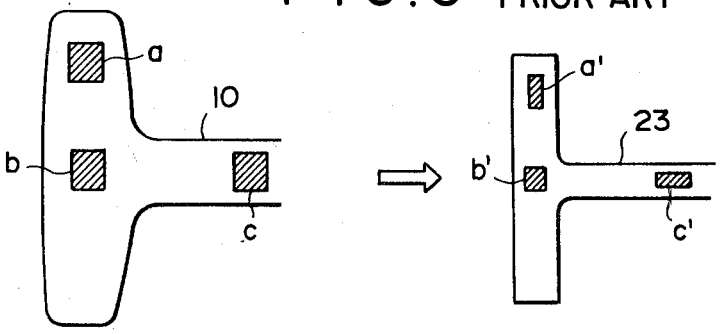
FIG. 3 PRIOR ART
FIG. 3 is a sectional view showing the state of deformation of each part of the piece rolled by the conventional method.
Figure 4A:
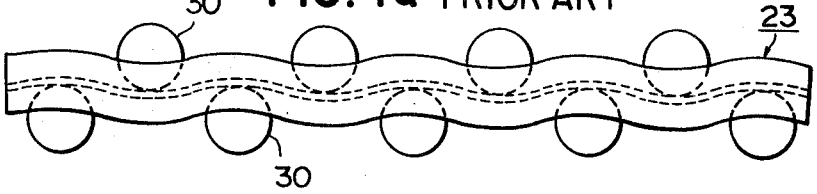
FIG. 4a PRIOR ART
FIG. 4 is a schematic view showing the state of the conventional H-beam when roller straightened.
Figure 4B:
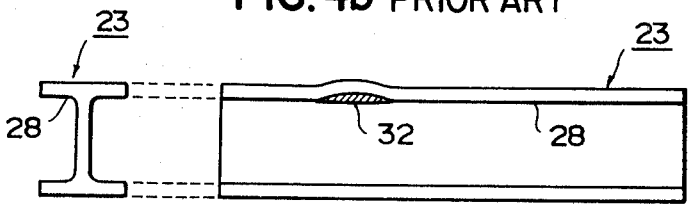
FIG. 4b PRIOR ART
Figure 5A:
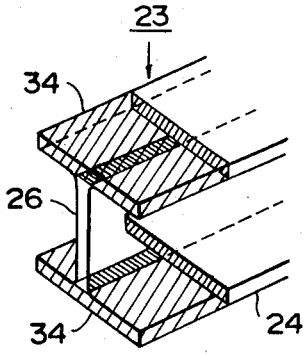
PRIOR ART FIG. 5a
FIG. 5 is a schematic view showing the cracking due to cutting of the conventional H-beam.
Figure 5B:
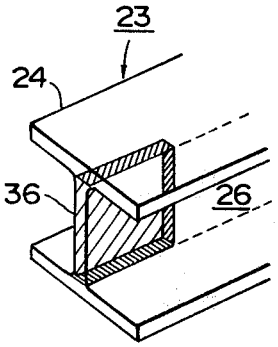
FIG. 5b PRIOR ART
Figure 5C:
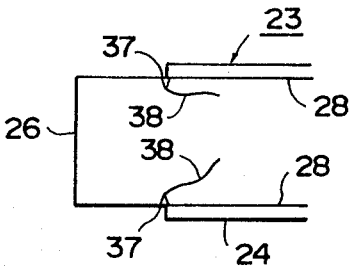
PRIOR ART FIG. 5c
Figure 5D:
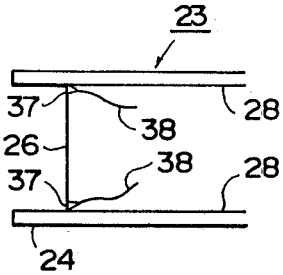
FIG. 5d PRIOR ART
Figure 6:
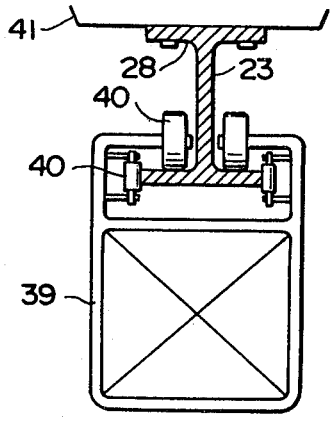
FIG. 6 is a schematic sectional view showing a monorail as an example of application of the H-beam.

An embodiment of this invention will be explained hereinbelow in detail with reference to drawings. This embodiment is different from the above-described example of the prior art in that in the above-described conventional roughing process there are alternately provided a process in which rolling is performed by a universal mill having a horizontal roll 42 of a cross section having concaves 44 at the inner side of each fillet of the piece being rolled, and a vertical roll 16 of the same cross section as the conventional one as shown in FIG. 7 (*a*), and a process in which rolling is performed by a universal mill having a vertical roll 48 of a cross section having a concave 46 in the vicinity of the outer side of the fillet of the piece being rolled, and a horizontal roll 14 of the same cross section as the conventional one as shown in FIG. 7 (*b*).

Figure 7A:
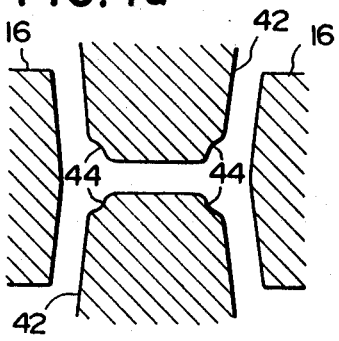
FIG. 7 is a sectional view showing the pass shape of a roughing universal mill used in the embodiment of this invention.
Figure 7B:
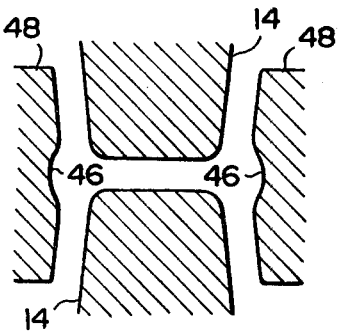
Figure 8A:
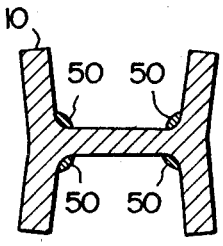
FIG. 8 is a sectional view showing the piece having convexes formed in the production process according to this invention.
Figure 8B:
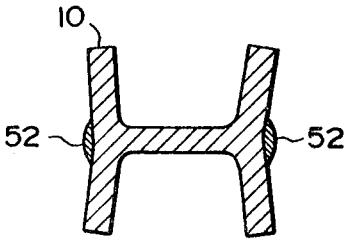

The piece 10 rolled by a universal mill having a pass shape shown in FIG. 7 (*a*) has convexes 50 formed at the inner side of each fillet as shown in FIG. 8 (*a*), while the piece 10 rolled by a universal mill having a pass shape shown in FIG. 7 (*b*) has convexes 52 formed at the outer side of each fillet as shown in FIG. 8 (*b*). Therefore, the piece 10 when repeatedly rolled by such universal mills is alternately shaped into the forms of FIG. 8 (*a*) and (*b*). That is, the piece alternates between the state in which convexes 50 are at the inner side of each fillet and the state in which convexes 52 are at the outer side of each fillet. Such displacement of convexes naturally takes place through the fillets, accompanied with movement of material (metal flow) of the fillets to the inner and outer sides thereof, which gives a large amount of strain to the fillets. This amount of strain is freely adjustable depending on the required number of passes in roughing universal mills and the size of pass provided in horizontal and vertical rolls of roughing universal mills.

The piece completing rolling in roughing mills has its convexes reduced by a finishing universal mill and is rolled into a H-beam having predetermined dimensions, in which process the fillets are also given a large amount of strain.

Generally the effects of material improvement of steel by hot working are classified into the following two. The first effect is due to working in the region in which austenite can recrystallize easily. The working in this region permits austenite to be fine-grained through repeated recrystallization and also ferrite after transformation to be fine-grained. The second effect is due to working in the region in which austenite cannot recrystallize. The working in this region accumulates strain in austenite, produces a deformation zone and causes austenite to become a ferrite precipitating nucleus at the time of transformation, so that ferrite grains become fine. In either of these regions, an increase in draft contributes to fine-graining of ferrite and consequently is connected with improvements in strength and toughness.

Figure 9:
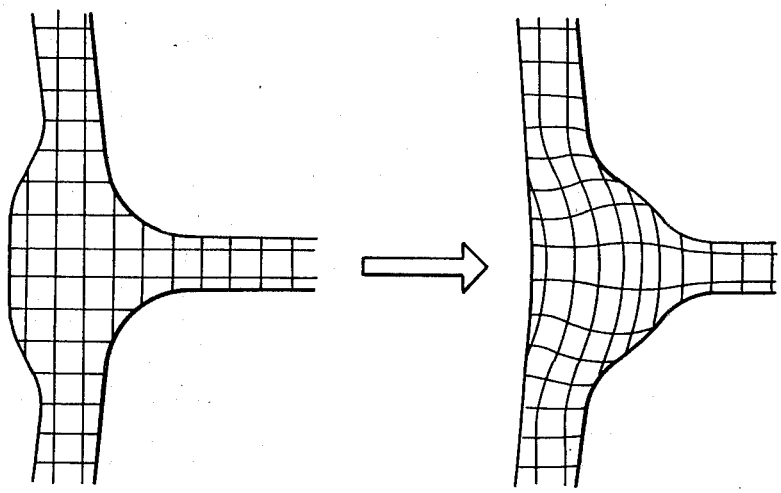
FIGS. 9 and 10 are schematic views showing the state of metal flow in the cross section of the piece rolled by the method of this invention.
Figure 10:
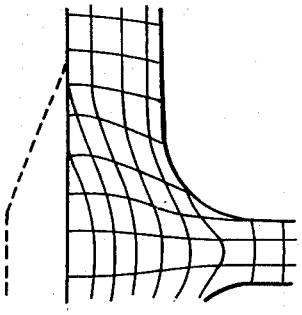
Figure 11:
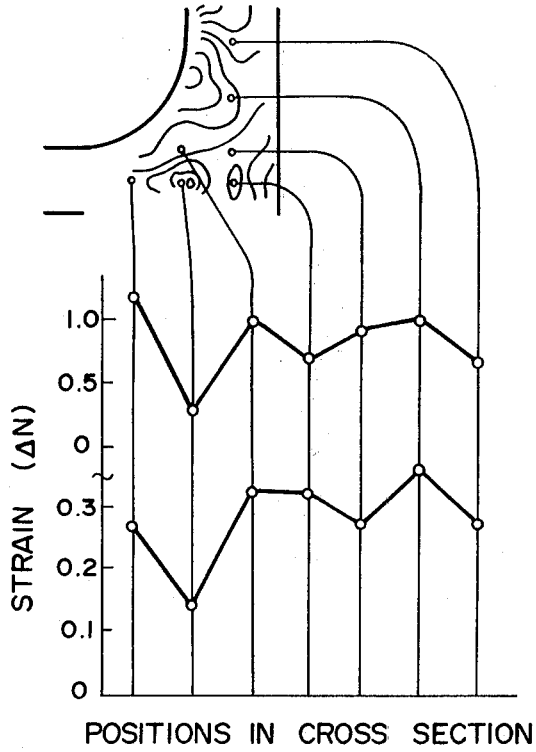
FIG. 11 is a diagram showing the relationship between the change of structure and the strain distribution in the cross section by the method of this invention.

FIG. 9 shows the state of internal metal flow in one pass in case the piece rolled by a roughing universal mill having the pass shape shown in FIG. 7 (*b*) is rolled by a roughing universal mill having the pass shape shown in FIG. 7 (*a*). FIG. 10 shows the state of internal metal flow in one pass in case the pieced rolled by a roughing universal mill having the pass shape shown in FIG. 7 (*b*) is rolled by a finishing universal mill. In either case, the lattice pattern of the square section before rolling is deformed into a parallelogram, from which it can be seen that a large shearing strain has taken place in addition to compressive strain. FIG. 11 gives a strain distribution diagram in which the amount of strain, obtained at different positions in the cross section when a metal flow similar to that in FIG. 10 is given, for example, in the region in which austenite cannot recrystallize, are evaluated by equivalent plastic strains, and shows the relationship between the amounts of strain at typical positions in the above strain distribution diagram and the degrees of fine-graining of ferrite (difference in JIS (Japanese Industrial Strandard) grain size number between the grain size obtained by the conventional rolling method and the grain size obtained when the fillets are given heavy reduction in one pass). From this figure it can be well understood that the amounts of strain at each position well correspond to the degrees of fine-graining of ferrite and that the shearing strain effectively works on the fine-graining of structure.

Thus, according to this invention, the amount of strain of the fillet can be sufficiently increased, and any desired quality of material can be obtained by adjusting the pass shape of roughing universal mills, number of passes and rolling temperature for each pass.

The concaves to be provided in the horizontal and vertical rolls of universal mills may be of any shape whatsoever if the following two conditions are satisfied. That is, firstly the pass shape must be such that no damages such as overlap are not caused when convexes formed by the pass shape are reduced till flattened by the succeeding mill. Secondarily sufficient metal flow must occur in the fillets when alternate rolling is performed by two roughing universal mills.

FIG. 12 shows a concrete pass shape used in the present embodiment. The concaves 44 provided in the horizontal roll 42 are formed by a circular arc r1 passing the points of contact m and n at which the circular arc R at the corner of the horizontal roll touches the surface and side of the horizontal roll, and a common tangent circular are r2 provided to make smooth the portion adjacent to the intersection. The depth of the concaves 44 is defined herein as being equal to the distance d1 between the intersection i of the circular arc R and the intersection j of the circular arc r1 each with the bisector of the angle formed by the surface and side of the horizontal roll.

On the other hand, the concave 46 provided in the vertical roll 48 is at a distance of d2 from the apex k of the center portion of the vertical roll and is formed by a straight line l, parallel to the axis of the vertical roll, a circular arc r3 passing the intersection P of the surface of the vertical roll and the perpendicular drawn from the point n on the horizontal roll to the surface of the vertical roll and touching the straight line l, and a common tangent circular arc r4 provided to make smooth the portion adjacent to the intersection P. The depth of the concave 46 in the vertical roll is defined herein as being equal to d2.

The circular arcs r2 and r4 each are given a suitable size so as to satisfy the above-described first condition. Further, in order to satisfy the above-described second condition, the relation between the depth d1 of the concave 44 and the depth d2 of the concave 46 is determined so that two times the cross-sectional area of the concave 44 is nearly equal to the cross-sectional area of the concave 46, and the absolute values of the depths d1 and d2 are determined from the amount of strain desired for the fillets.

The total cross-sectional area of the concaves 44 in the horizontal rolls is made equal to the cross-sectional area of the concave 46 in the vertical roll in case repeated rolling is performed by two roughing universal mills as is in the present embodiment. For example, in the case of full-continuous rolling in which rolling in only one pass is performed by each mill, the cross-sectional areas of concaves in mills located understream in the rolling process may be decreased in accordance with decreases in cross-sectional area of the piece being rolled by each mill.

The combination of pass groove positions may be different from that shown in the embodiment if the above-described first and second conditions are satisfied. For example, the combination, as shown in FIG. 13 (*a*), of concaves 56 and 58 formed in vertical rolls 54 and 55 respectively, or the combination, as shown in FIG. 13 (*b*), of concaves 62 and 64 formed in top and bottom horizontal rolls 60 and 61 respectively may be employed.

This invention is applicable in any mill arrangement if it includes two or more universal mills in addition to a finishing universal mill. FIG. 14 (*a*), (*b*) and (*c*) are examples of mill arrangement. In the figure, the reference numerals 70, 72, 74 and 76 designate a breakdown mill, roughing universal mill, edging mill and finishing universal mill respectively. In the mill arrangement shown in FIG. 14 (*a*), rolling in one pass or in two passes or more is performed by a roughing universal mill group consisting of the roughing universal mill **72*a* having the pass shape shown in FIG. 7** (*a*), edging mill **74*a*, roughing universal mill 72*b* having the pass shape shown in FIG. 7** (*b*), and edging mill **74*b*, and finish rolling is then performed by the finishing universal mill 76 having a pass shape similar to the conventional one. In the mill arrangement shown in FIG. 14** (*b*), rolling in one pass or in two passes or more is performed by a roughing universal mill group consisting of the roughing universal mill **72*a* having the pass shape shown in FIG. 7** (*a*), the sizes of $r_1$, $r_2$, R and $d_1$ of concaves 44 of horizontal roll 42 for making H shape size 400×200×8×13 (height 400 mm, flange-width 200 mm, web-thickness 8 mm, flange-thickness 13 mm) are 36 mm, 10 mm, 19 mm and 6 mm respectively, edging mill **74*a* and roughing universal mill 72*b* having the pass shape shown in FIG. 7** (*b*), the sizes of $r_3$, $r_4$ and $d_2$ of concave 46 of vertical roll 48 are 40 mm, 25 mm and 8 mm respectively, and rolling in one pass is then performed by a finishing universal mill group consisting of the roughing universal mill **72*c* having the pass shape shown in FIG. 7** (*a*) or a conventional pass shape, edging mill **74*b* and finishing universal mill 76. The mill arrangement shown in FIG. 14** (*c*) is an example of full-continuous mill arrangement, in which case the roughing universal mill 72-i has the pass shape shown in FIG. 7 (*a*), the roughing universal mill 72-(i+1) has the pass shape shown in FIG. 7 (*b*), and the finishing universal mill 76 has a conventional pass shape. In this case, if the pass shapes shown in FIGS. (*a*) and (*b*) are alternately adopted in at least two or more successive universal mills, universal mills upstream and downstream thereof may have a conventional pass shape.

The test results of mechanical properties of H-beam produced according to this invention are given in Table 1.

The mill arrangement used in this experiment is that shown in FIG. 14 (*b*). The pass shape of the roughing universal mill 72*a* is that shown in FIG. 7 (*b*), the pass shape of the roughing universal mill 72*b* is that shown in FIG. 7 (*a*), the pass shape of the roughing universal mill 72*c* is that shown in FIG. 7 (*b*), and the pass shape of the finishing universal mill 76 is a conventional one. Rolling in three passes was performed by a roughing universal mill group consisting of the roughing universal mill 72*a*, edging mill 74*a* and roughing universal mill 72*b*, and finish rolling in on pass was then performed by the roughing universal mill 72*c*, edging mill 74*b* and finishing universal mill 76. As is seen from the table, in the H-beams thus produced, as compared with those produced by the conventional rolling method, the fillets are improved in both strength and toughness nearly to the level of the flanges of the same finish temperature.

TABLE 1

| Size | | 400 × 200 × 8 × 13 | | | |
|---|---|---|---|---|---|
| Specification (JIS G3101-1976) | | SS41 | | SM50A | |
| Chemical composition of steels (%) | | C: 0.19, Si: 0.07, Mn: 0.61, P: 0.021, S: 0.015 | | C: 0.18, Si: 0.21, Mn: 1.25, P: 0.023, S: 0.013 | |
| Method | | Conventional | According to this invention | Conventional | According to this invention |
| Temperature of fillet | Roughing mill 72a (Third pass) | 920° C. | | 920° C. | |
| | Roughing mill 72C | 905° C. | | 900° C. | |
| | Finishing mill 76 | 880° C. | | 875° C. | |
| Material of fillet | Yield point | 30.6 kg/mm² | 33.5 kg/mm² | 36.5 kg/mm² | 39.0 kg/mm² |
| | Tensile strength | 45.0 kg/mm² | 45.7 kg/mm² | 53.0 kg/mm² | 53.8 kg/mm² |
| | Transition temperature of fractured surface | +5° C. | −10° C. | −15° C. | −32.5° C. |
| Material of flange of the same finish temperature | Yield point | 33.2 kg/mm² | | 39.2 kg/mm² | |
| | Tensile strength | 46.0 kg/mm² | | 54.2 kg/mm² | |
| | Transition temperature of fractured surface | −10° C. | | −30° C. | |

It should be apparent to one skilled in the arts that the above described embodiments are merely illustrative of but a few of the many possible specific embodiments which represent the application of the principles of the present invention. Numerous and varied other arrangements can be readily devised by those skilled in the art without departing from the spirit and scope of the invention.

What is claimed is:

1. An apparatus for producing a steel H-beam having joints of a piece being rolled between a web and flanges having high mechanical strength and toughness, comprising:

a breakdown mill having breakdown rolls;

a first roughing universal mill having horizontal rolls each having concaves in cross-section at portions corresponding to portions at the inner side of each joint between the web and the flanges of the piece being rolled, and vertical rolls;

an edging mill;

a second roughing universal mill having vertical rolls each having a concave in cross-section at a portion corresponding to a portion in the vicinity of the outer side of the joint of said piece being rolled, and horizontal rolls;

a second edging mill; and a finishing universal mill.

2. An apparatus for producing a steel H-beam having joints of a piece being rolled between a web and flanges having high mechanical strength and toughness, comprising:

a breakdown mill having breakdown rolls;

a first roughing universal mill having horizontal rolls each having concaves in cross-section at portions corresponding to portions at the inner side of each joint of said piece being rolled, and vertical rolls;

a first edging mill;

a second roughing universal mill having horizontal rolls each having a concave in cross-section at a portion corresponding to a portion in the vicinity of the outer side of the joint of said piece being rolled, and vertical rolls;

a second edging mill; and a finishing universal mill.

3. An apparatus for producing a steel H-beam having joints of a piece being rolled between a web and flanges having high mechanical strength and toughness, comprising:

a breakdown mill having breakdown rolls;

a first roughing universal mill having horizontal rolls each having concaves in cross-section at portions corresponding to portions at the inner side of each joint of said piece being rolled, and vertical rolls;

a second roughing universal mill separated from said first roughing universal mill by an edging mill, said second mill having vertical rolls each having a concave in cross-section at a portion corresponding to a portion in the vicinity of the outer side of the joint of said piece being rolled, and horizontal rolls;

a second edging mill; and a finishing universal mill.

* * * * *